US010786888B2

(12) United States Patent
Chung et al.

(10) Patent No.: US 10,786,888 B2
(45) Date of Patent: Sep. 29, 2020

(54) TWIN HAMMER IMPACT TOOL

(71) Applicant: Techway Industrial Co., Ltd., Taichung (TW)

(72) Inventors: Fu-Hsiang Chung, Taichung (TW); Hao-Jung Yeh, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 154 days.

(21) Appl. No.: 16/053,974

(22) Filed: Aug. 3, 2018

(65) Prior Publication Data

US 2019/0358789 A1 Nov. 28, 2019

(30) Foreign Application Priority Data

May 25, 2018 (TW) ..... 107117860 A

(51) Int. Cl.
*B25B 21/02* (2006.01)
*B25F 5/00* (2006.01)

(52) U.S. Cl.
CPC ..... *B25B 21/02* (2013.01); *B25F 5/001* (2013.01)

(58) Field of Classification Search
CPC ..... B25B 21/02; B25B 21/026; B25F 5/001
USPC .... 173/90, 93–93.7, 170, 171, 176, 109, 48, 173/122
See application file for complete search history.

(56) References Cited

U.S. PATENT DOCUMENTS 4,313,505 A * 2/1982 Silvern ..... B25B 21/026 173/93.5
8,490,714 B2 * 7/2013 Nakamura ..... B25B 21/00 173/93
9,205,547 B2 * 12/2015 Hirabayashi ..... B25D 16/006
9,266,226 B2 * 2/2016 Timmons ..... B25B 21/02
9,975,224 B2 * 5/2018 Tanaka ..... B25B 21/026
10,016,881 B2 * 7/2018 Aoyagi ..... B25B 21/02
2006/0266537 A1 * 11/2006 Izumisawa ..... B25B 21/026 173/176
2012/0111592 A1 * 5/2012 Limberg ..... B25B 23/1405 173/48

(Continued)

FOREIGN PATENT DOCUMENTS

CN 107175610 A 9/2017
EP 1120199 A2 * 8/2001 ..... B25B 21/02

(Continued)

OTHER PUBLICATIONS

Office Action issued to German counterpart application No. 102018216162.3 by the GPTO dated May 29, 2019.

(Continued)

*Primary Examiner* — Chelsea E Stinson
*Assistant Examiner* — Himchan Song
(74) *Attorney, Agent, or Firm* — Burris Law, PLLC

(57) ABSTRACT

A twin hammer impact tool includes a hammer spindle, an inner ring hammer sleeved on the hammer spindle, an outer ring hammer disposed around the inner ring hammer, and rolling beads. The inner ring hammer has bead grooves each having a ball half-shape, and angularly spaced-apart hammer projections. The inner ring hammer is reciprocally movable relative to the hammer spindle while rotating together with the hammer spindle. The outer ring hammer has guiding grooves. The bead grooves respectively face and open toward the guiding grooves. Each rolling bead is received within one of the bead grooves and one of the guiding grooves. An output hammer has angularly spaced engagement projections to engage the hammer projections.

7 Claims, 7 Drawing Sheets

(56) References Cited

U.S. PATENT DOCUMENTS

| | | | | |
|---|---|---|---|---|
| 2013/0032370 | A1* | 2/2013 | Hirabayashi | B25D 11/106 173/47 |
| 2013/0192860 | A1* | 8/2013 | Puzio | B25F 5/00 173/47 |
| 2016/0075004 | A1* | 3/2016 | Tsubakimoto | B25B 21/02 173/93 |
| 2016/0176027 | A1* | 6/2016 | Aoyagi | B25B 21/026 173/93.6 |
| 2017/0259411 | A1* | 9/2017 | Ishibashi | B25B 21/026 |
| 2018/0272510 | A1* | 9/2018 | Muramatsu | B25D 11/104 |

FOREIGN PATENT DOCUMENTS

| | | | |
|---|---|---|---|
| EP | 1120199 | A2 | 8/2001 |
| EP | 2554332 | A2 | 2/2013 |
| JP | S59183761 | U | 12/1984 |
| JP | 2010-280021 | A | 12/2010 |
| JP | 2013-35091 | A | 2/2013 |

OTHER PUBLICATIONS

Office Action issued to Japanese counterpart application No. 2018-176488 by the JPO dated Jan. 7, 2020.
Examination report issued to Australian counterpart application No. 2018233008 by the IP Australia dated Aug. 1, 2019.

* cited by examiner

TWIN HAMMER IMPACT TOOL

CROSS-REFERENCE TO RELATED APPLICATION

This application claims priority of Taiwanese Patent Application No. 107117860, filed on May 25, 2018.

FIELD

The disclosure relates to an impact tool, and more particularly to a twin hammer impact tool.

BACKGROUND

A conventional single hammer impact tool has a single hammer and an output hammer. The single hammer is driven to reciprocally move along and rotate about an axial line for striking the output hammer engaging a workpiece. To produce a relatively large impact force, the conventional single hammer impact tool is generally designed to increase mass so as to improve rotational inertia. However, such a design can produce relatively large vibration, which reduces operational ability and comfortability during a hammering operation.

A conventional twin hammer impact tool, as disclosed in Chinese Patent Application No. 107175610 A, includes a primary hammer and a secondary hammer. The primary hammer is reciprocally movable along and rotatable about an axial line. The secondary hammer is rotatable together with the primary hammer while being immobilized along the axial line. Compared with the conventional single hammer impact tool, the conventional twin hammer impact tool is advantageous to enhance rotational inertia and to reduce vibration. However, the conventional twin hammer impact tool has to be provided with a plurality of needle rollers respectively inserted into roller channels formed between the primary and secondary hammers for transmitting driving movements. To retain the needle rollers, it is required to additionally provide an elastic retention ring. Furthermore, there are other disadvantages that can lead to an unsmooth operation and an increased vibration. For instance, the needle rollers can swing due to positional deviation; the accuracy of processing the needle channels can be insufficient; frictional forces between the needle rollers and needle channels can be overly high.

SUMMARY

Therefore, an object of the disclosure is to provide a twin hammer impact tool that can alleviate at least one of the drawbacks of the prior art.

According to the disclosure, a twin hammer impact tool includes a motor, a drive unit, a hammer unit and a housing unit.

The motor includes a motor shaft.

The drive unit is driven by the motor, and includes a gear set connected to the motor shaft.

The hammer unit is connected to the drive unit, and includes a hammer spindle, an inner ring hammer, an outer ring hammer, a plurality of rolling beads, and an output hammer.

The hammer spindle extends along and is rotatable about an axial line of the motor shaft. The hammer spindle has a driven end connected to the gear set, and an output end opposite to the driven end.

The inner ring hammer is sleeved on the hammer spindle. The inner ring hammer has a plurality of bead grooves each having a ball half-shape, and a plurality of angularly spaced-apart hammer projections disposed around the output end of the hammer spindle. The inner ring hammer is reciprocally movable relative to the hammer spindle along the axial line while rotating together with the hammer spindle.

The outer ring hammer is disposed around the inner ring hammer. The outer ring hammer has a plurality of guiding grooves disposed around and extending along the axial line. The bead grooves respectively face and open toward the guiding grooves.

Each of the rolling beads is received within one of the bead grooves and one of the guiding grooves.

The output hammer is connected to the output end of the hammer spindle, and has a main body extending along the axial line for engaging a workpiece, and a plurality of angularly spaced engagement projections protruding radially from the main body for engaging the hammer projections.

The housing unit covers the motor, the drive unit and the hammer unit, and has an opening for the main body of the output hammer to extend outwardly.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
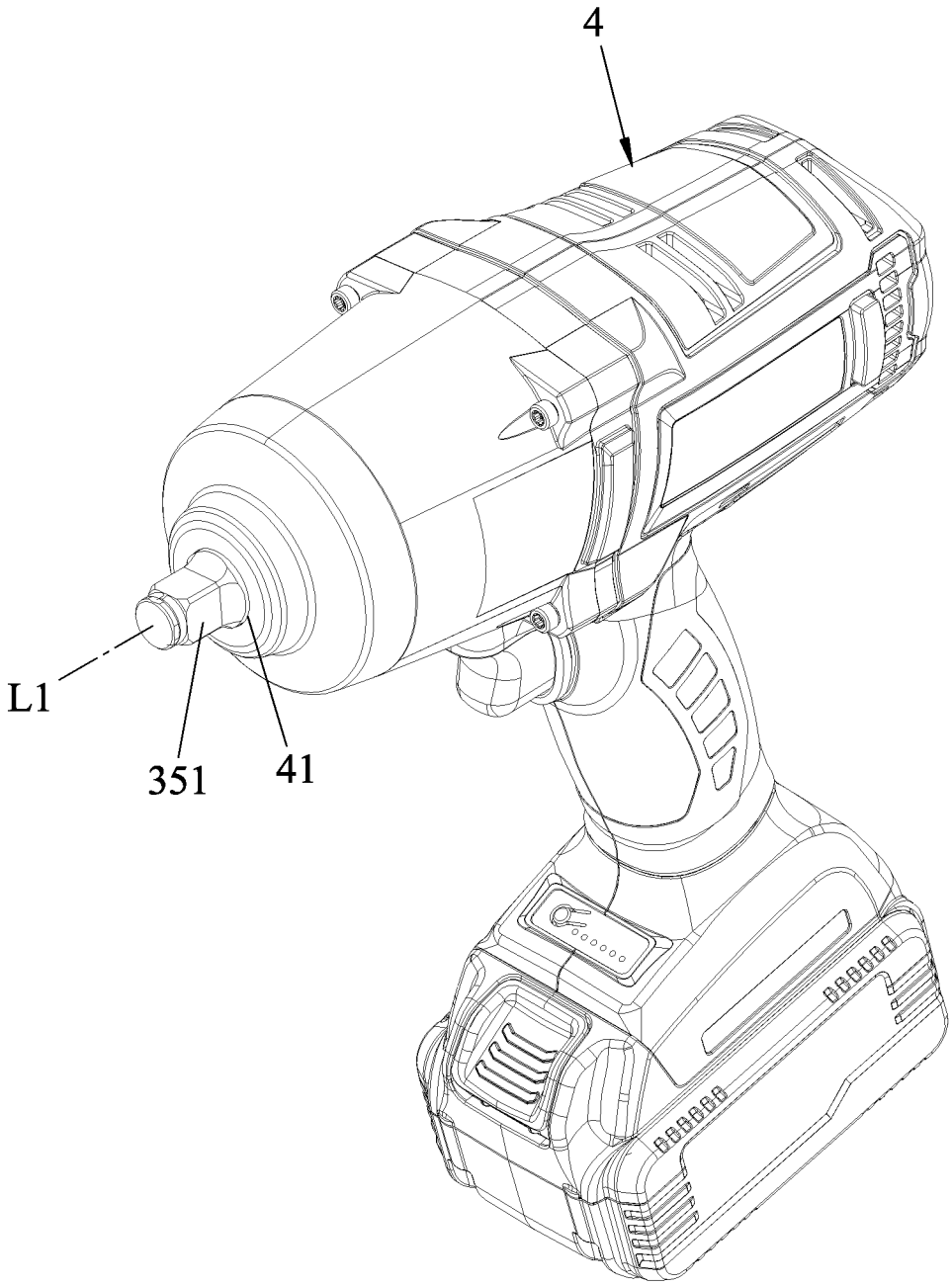
FIG. 1 is a perspective view illustrating a first embodiment of a twin hammer impact tool according to the disclosure.
Figure 2:
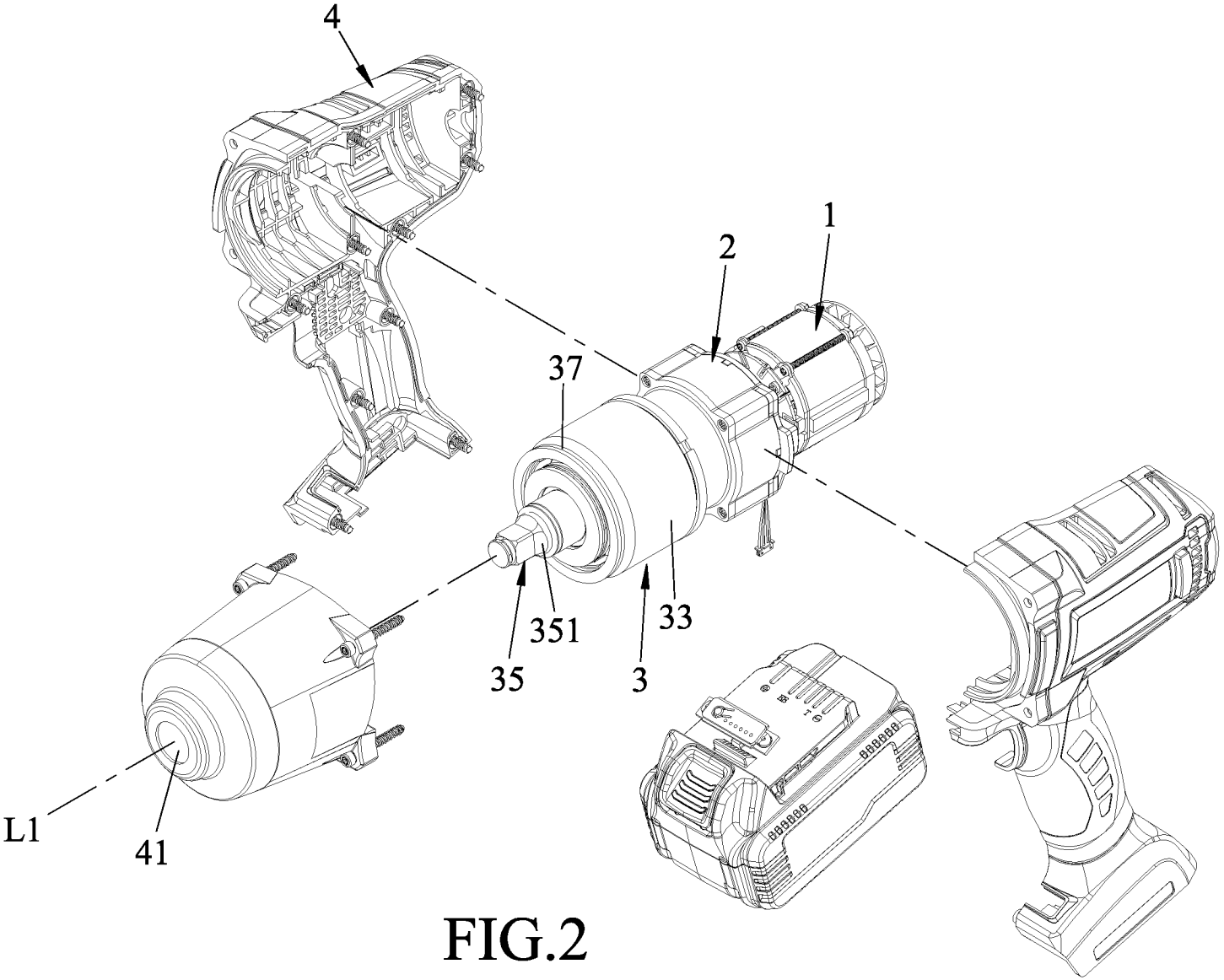
FIG. 2 is an exploded perspective view of the first embodiment.
Figure 3:
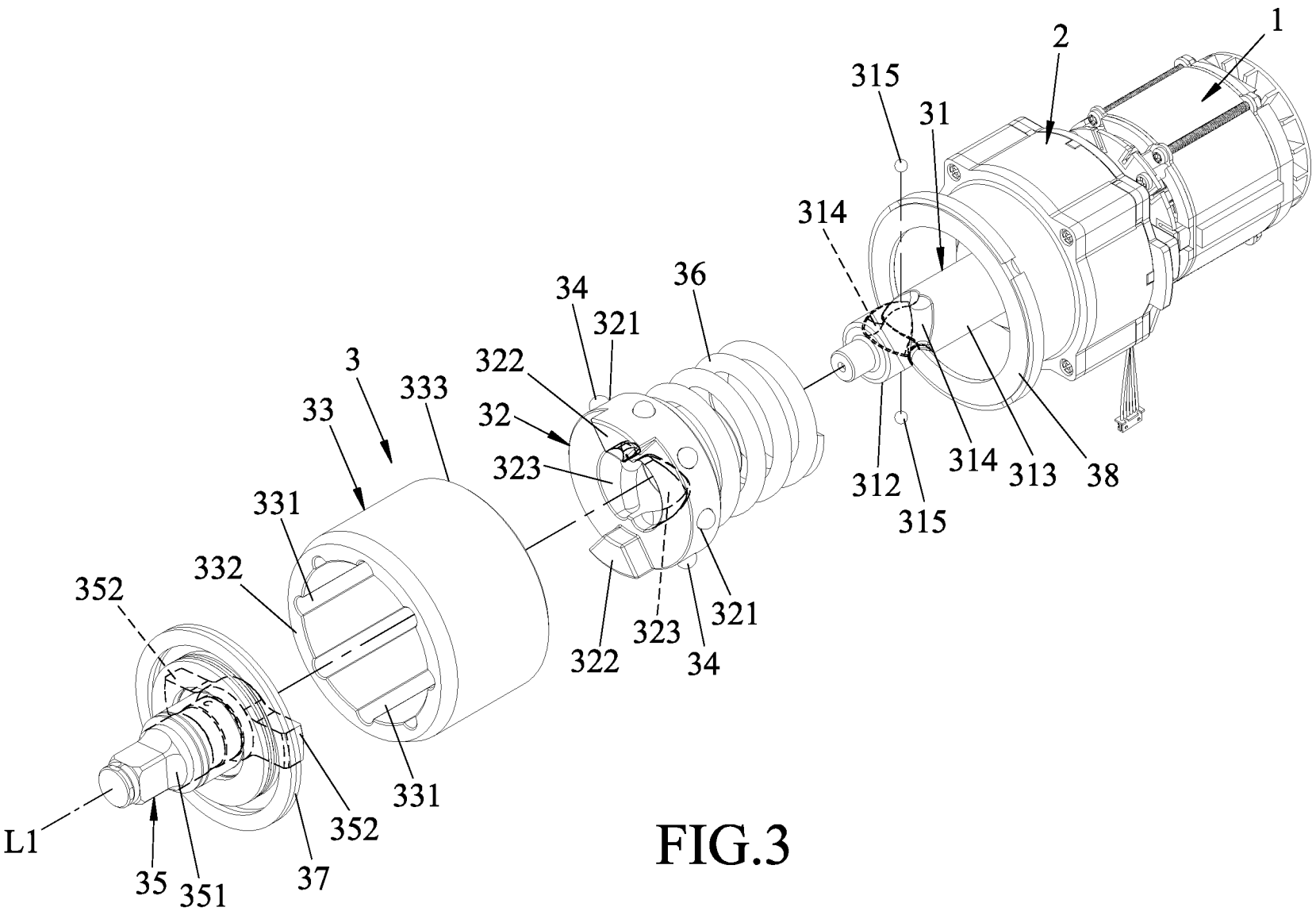
FIG. 3 is an exploded view of the first embodiment illustrating a motor, a drive unit and a hammer unit of the twin hammer impact tool.
Figure 4:
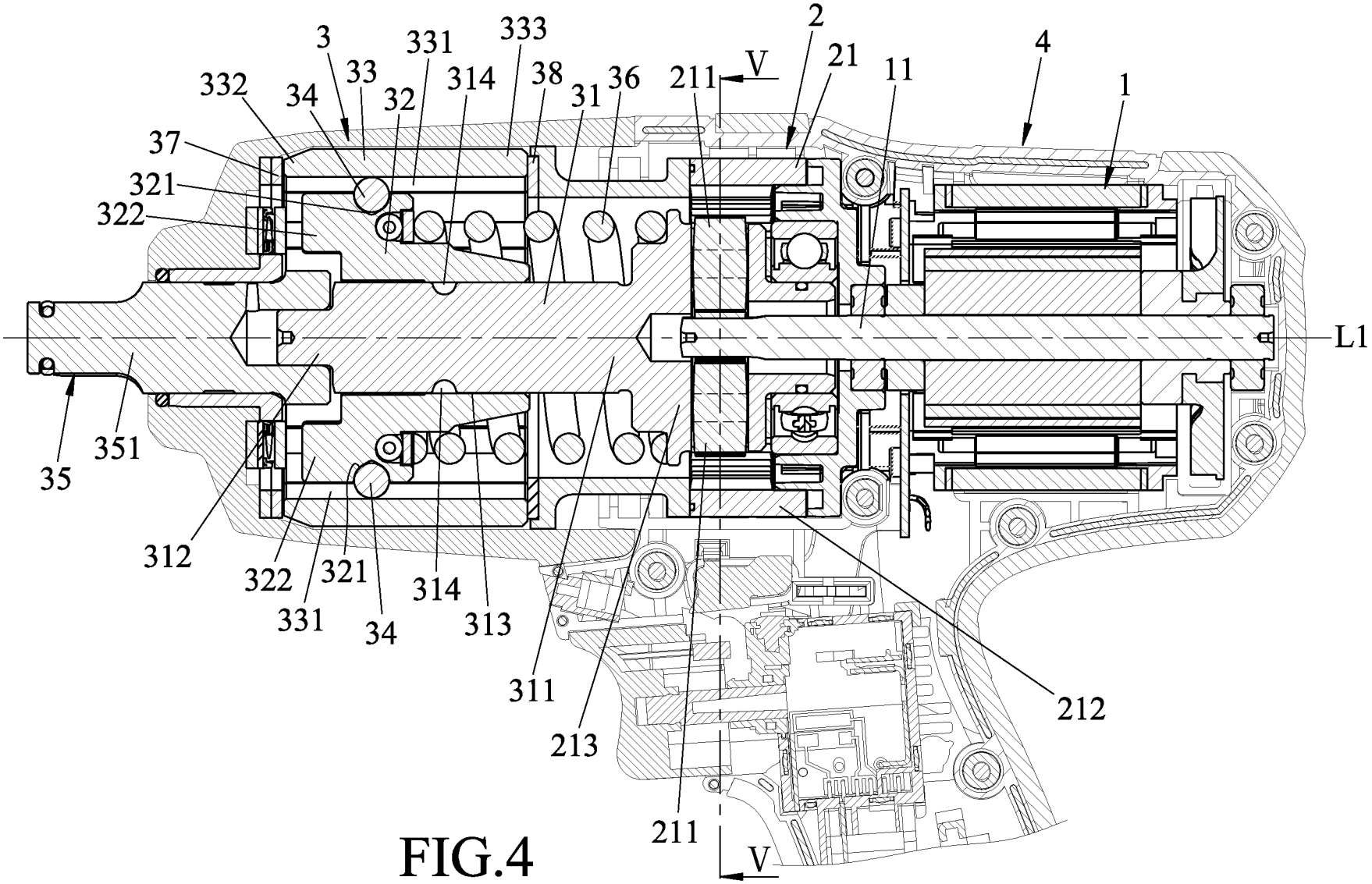
FIG. 4 is a fragmentary sectional view of the first embodiment.
Figure 5:
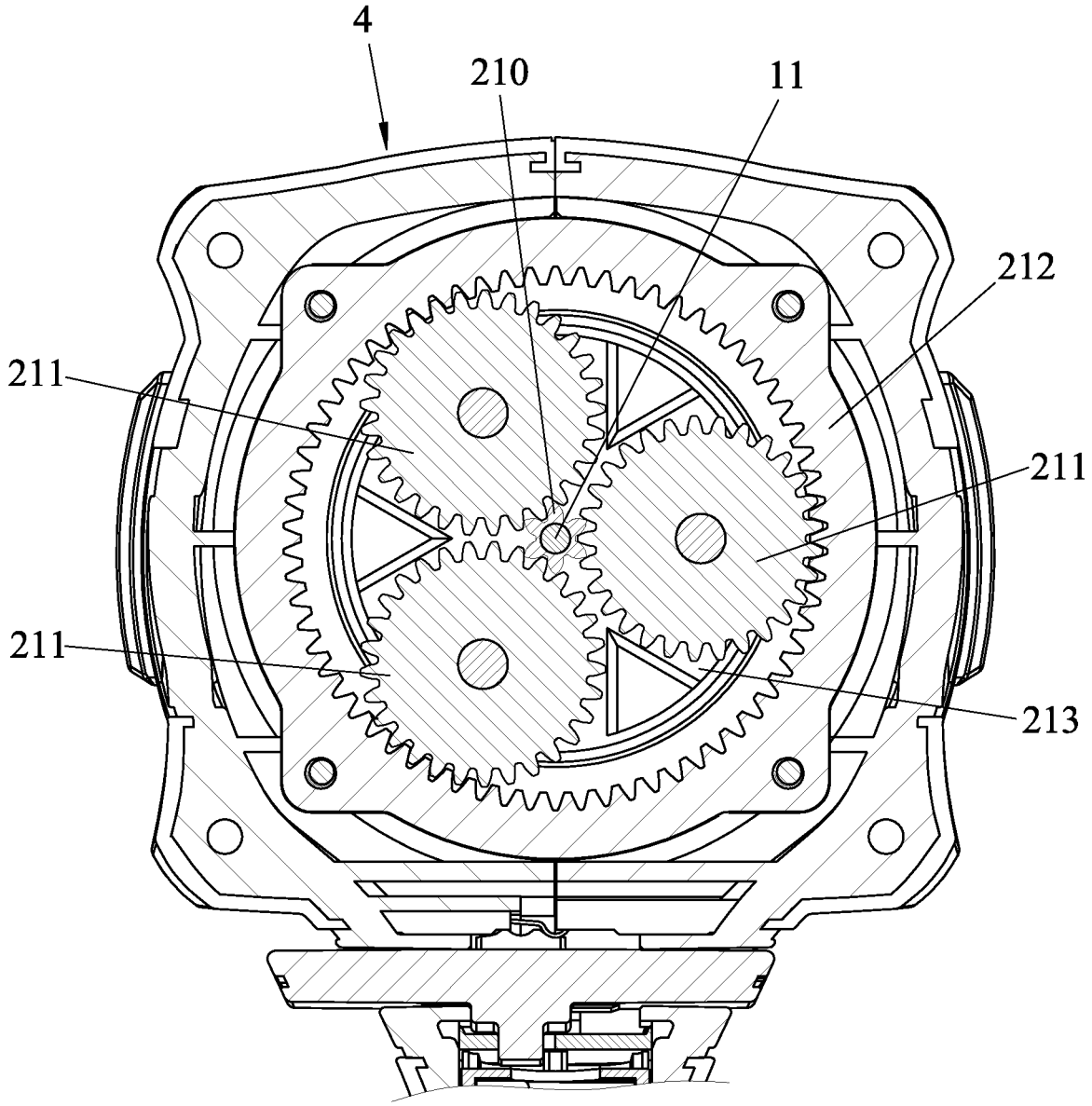
FIG. 5 is a fragmentary sectional view of the first embodiment taken along line V-V of FIG. 4.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 1 to 5, there is shown a first embodiment of a twin hammer impact tool according to the disclosure. The twin hamper impact tool includes a motor 1, a drive unit 2, a hammer unit 3 and a housing unit 4. The hammer unit 3 has a hammer spindle 31.

The motor 1 includes a motor shaft 11.

The drive unit 2 is driven by the motor 1, and includes a gear set 21 connected to the motor shaft 11. The gear set 21 has a sun gear 210 connected to the motor shaft 11, a carrier 213, a plurality of planetary gears 211 mounted to the carrier 213 and meshed with the sun gear 210, and a ring gear 212 meshed with the planetary gears 211. The carrier 213 is connected to the hammer spindle 31. The ring gear 212 is disposed around the planetary gears 211 and positioned to the housing unit 4.

The hammer unit 3 is connected to the drive unit 2, and further includes an inner ring hammer 32, an outer ring hammer 33, a plurality of rolling beads 34, an output hammer 35, a spring 36, a first packing ring 37 and a second packing ring 38.

The hammer spindle 31 extends along and rotatable about an axial line (L1) of the motor shaft 11. The hammer spindle 31 has a driven end 311 connected to the carrier 213, an output end 312 opposite to the driven end 311, an outer surface 313, and two V-shaped grooves 314 indented from the outer surface 313.

The inner ring hammer 32 is sleeved on the hammer spindle 31. Further, the inner ring hammer 32 has a plurality of bead grooves 321 each having a ball half-shape, a plurality of angularly spaced-apart hammer projections 322 disposed around the output end 312 of the hammer spindle 31, and two sliding grooves 323 respectively facing the V-shaped grooves 314. The bead grooves 321 are arranged annularly around the axial line (L1) and are equiangularly spaced apart from each other. In addition, the hammer unit 3 further includes two rolling elements 315. Each rolling element 315 is disposed between one of the V-shaped grooves 314 and one of the sliding grooves 323. While the bead grooves 321 are arranged annularly around the axial line (L1) and are equiangularly spaced apart from each other for uniform stress distribution the disclosure is not limited to this embodiment.

The output hammer 35 is connected to the output end 312 of the hammer spindle 31, and has a main body 351 extending along the axial line (L1) for engaging a workpiece, and a plurality of angularly spaced engagement projections 352 protruding radially from the main body 351 for engaging the hammer projections 322.

The outer ring hammer 33 is disposed around the inner ring hammer 32. The outer ring hammer 33 has a plurality of guiding grooves 331 disposed around and extending along the axial line (L1), a first end 332 disposed around a portion of the main body 351 of the output hammer 35 proximal to the output end 312 of the hammer spindle 31, and a second end 333 opposite to the first end 332. Each guiding groove 331 has a curve-shaped cross section. The bead grooves 321 respectively face and open toward the guiding grooves 331.

Each rolling bead 34 is received within one of the bead grooves 321 and one of the guiding grooves 331.

The spring 36 is sleeved on the hammer spindle 31 and connects between the carrier 213 and the inner ring hammer 32.

The first packing ring 37 is disposed around the main body 351 of the output hammer 35 and abuts the first end 332 of the outer ring hammer 33.

The second packing ring 38 is disposed around the hammer spindle 31 and abuts the second end 333 of the outer ring hammer 33. The first and second packing rings 37, 38 are stationarily positioned inside the housing unit 4. In particular, the first packing ring 37 is positioned to an inner surface of the housing unit 4.

It should be noted that the disclosure is not limited to the numbers of the bead grooves 321, the guiding grooves 331, the rolling beads 34, the hammer projections 322 and/or the engagement projections 352 of the first embodiment.

The housing unit 4 covers the motor 1, the drive unit 2 and the hammer unit 3, and has an opening 41 for the main body 351 of the output hammer 35 to extend outwardly.

When the motor 1 is activated, the motor shaft 11 drives the planetary gears 211 to rotate together with the carrier 213 such that the hammer spindle 31 connected to the carrier 213 rotates about the axial line (L1). Because the spring 36 connects between the carrier 213 and the inner ring hammer 32, the inner ring hammer 32 rotates concomitantly with the carrier 213. During rotation of the inner ring hammer 32, the rolling elements 315 respectively slide in the V-shaped grooves 314 such that the inner ring hammer 32 is reciprocally moved along the axial line (L1) relative to the hammer spindle 31 while being rotated together with the hammer spindle 31. Because the rolling beads 34 connect the outer and inner ring hammers 33, 32, the outer ring hammer 33 rotates concomitantly with the inner ring hammer 32 during rotation of the inner ring hammer 32. Besides, because the rolling beads 34 are allowed to move within the guiding grooves 331 of the outer ring hammer 33 along the axial line (L1), the movement of the inner ring hammer 32 along the axial line (L1) will not be affected by the rolling beads 34. Because the first and second packing rings 37, 38 are stationarily positioned inside the housing unit 4, the outer ring hammer 33 is immobilized between the first and second packing rings 37, 38 and prevented from moving or vibrating along the axial line L1 while being rotated about the axial line (L1). In other words, the outer ring hammer 33 can only rotate about but not move along the axial line (L1).

When the inner ring hammer 32 rotates together with the hammer spindle 31, because the engagement projections 352 of the output hammer 35 engage the respective hammer projections 322 of the inner ring hammer 32, the output hammer 35 moves and rotates together with the inner ring hammer 32. When the output hammer 35 engages the workpiece and is loaded, the inner ring hammer 32 moves and presses the spring 36 along the axial line (L1) until the hammer projections 322 of the inner ring hammer 32 disengage from the engagement projections 352 of the output hammer 35. The energy of the spring 36 is therefore released and the hammer projections 322 of the inner ring hammer 32 rotate at a high speed and strike the engagement projections 352 of the output hammer 35 to perform a screw-driving operation.

The twin hammer impact tool of the disclosure has the following effects:

1. The outer ring hammer 33 rotated by the inner ring hammer 32 can effectively increase rotational inertia to adjust the hammering force.

2. Compared with a conventional single hammer impact tool, the outer ring hammer 33 in the first embodiment can be effectively prevented from vibrating along the axial line L1 during a hammering operation.

3. Unlike the conventional twin hammer impact tool disclosed in Chinese Patent Application No. 107175610 A, the first embodiment utilizes the rolling beads 34 which are not needle-shaped. Compared to needle rollers used in the conventional twin hammer impact tool, the rolling beads 34 have relatively small contact areas to contact respective bead grooves 321 and respective guiding grooves 311. Therefore, frictional forces produced by the rolling beads 34 can be reduced to enhance smoothness of the hammering operation.

4. By using the rolling beads 34, problems of positional displacement and undesired swinging motions encountered by the conventionally used needle rollers can be avoided, and the elastic retention ring required in the conventional twin hammer impact tool can be dispensed with. Therefore, vibration is much reduced and construction is simplified.

5. During manufacturing, because each rolling bead 34 has a relatively small length and relatively small contact area, the guiding grooves 311 can be easily formed without needing high level of processing accuracy, thereby reducing manufacturing costs.

Figure 6:
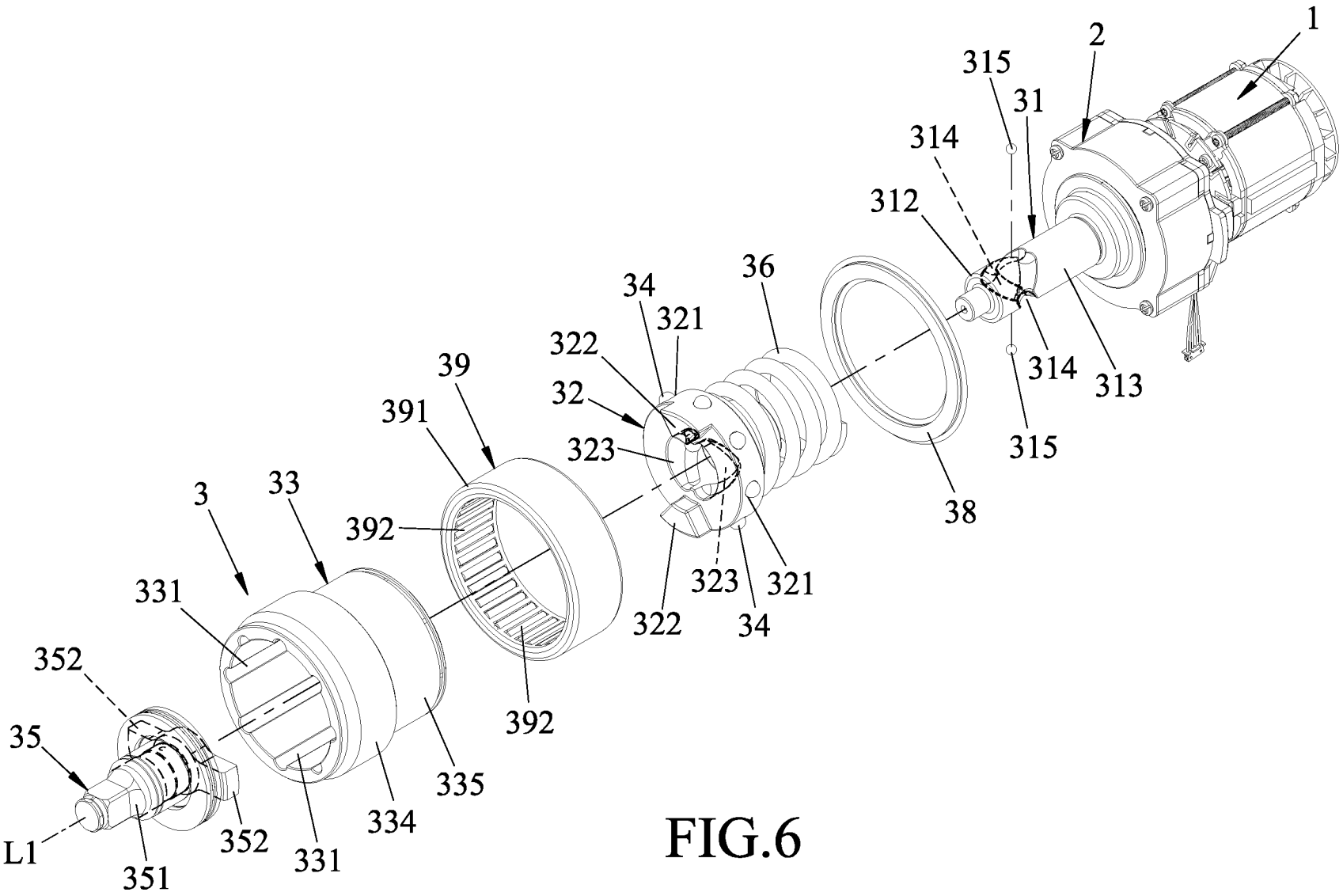
FIG. 6 is a partly exploded perspective view illustrating a second embodiment of a twin hammer impact tool according to the disclosure.
Figure 7:
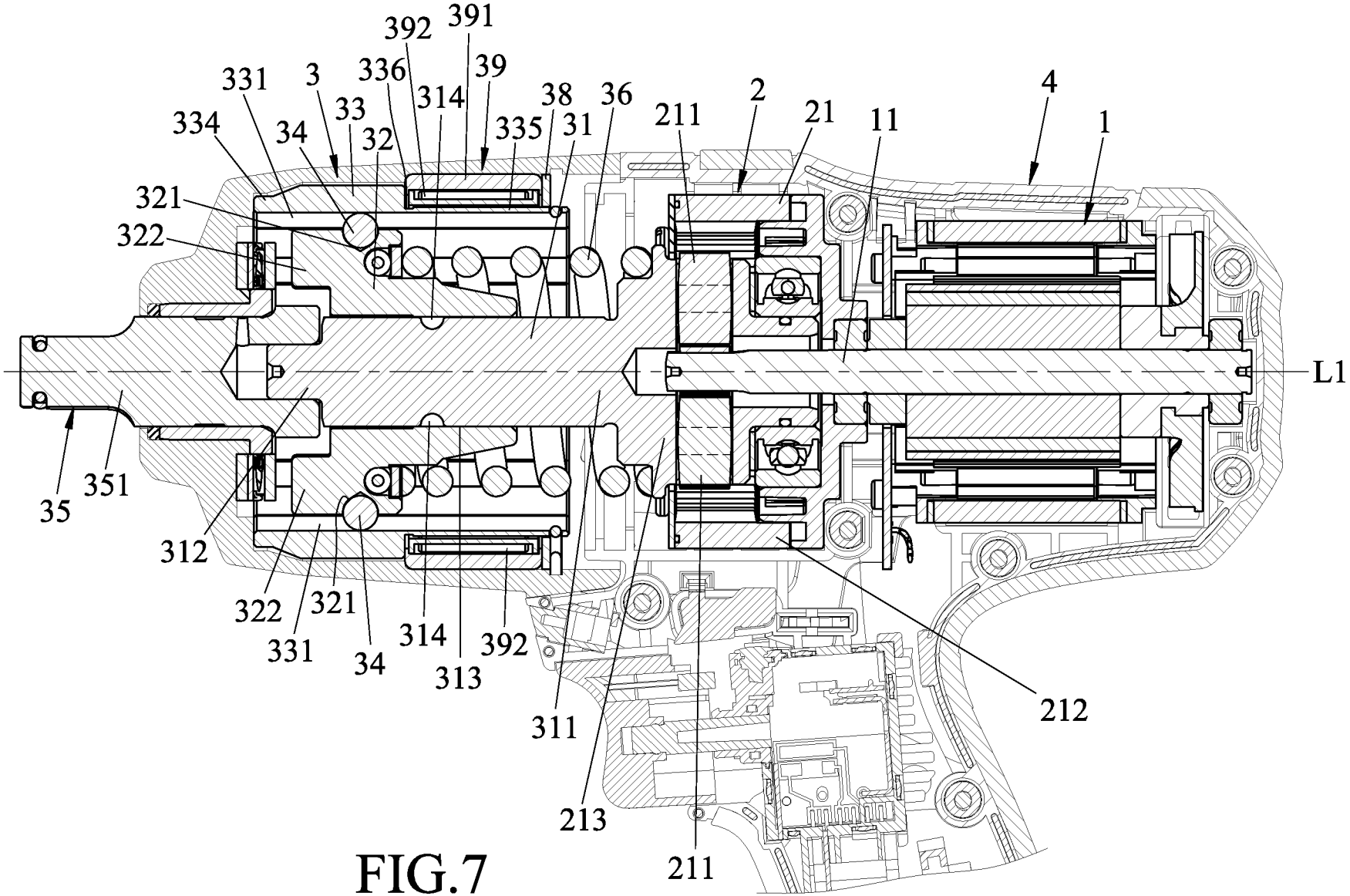
FIG. 7 is a fragmentary sectional view of the second embodiment.

FIGS. 6 and 7 illustrate a second embodiment according to a twin hammer impact tool of the disclosure, which has a structure generally similar to that of the first embodiment.

However, in this embodiment, the hammer unit 3 further includes a roller bearing unit 39 and the first packing ring 37 is omitted. The outer ring hammer 33 further has a head portion 334 disposed around a portion of the main body 351 of the output hammer 35 proximate to the output end 312 of the hammer spindle 31, and a neck portion 335 extending from the head portion 334 toward the gear set 21. The head portion 334 abuts an inner surface of the housing unit 4. The second packing ring 38 (hereinafter referred to as "the packing ring 38") is disposed around the neck portion 335 of the outer ring hammer 33. The roller bearing unit 39 has a roller housing ring 391 and a plurality of cylindrical rollers 392. The roller housing ring 391 is sleeved on the neck portion 335 of the outer ring hammer 33, and is disposed between and in abutment with the packing ring 38 and a shoulder face 336 formed at the juncture of the head and neck portions 334, 335 of the outer ring hammer 33. The cyndrical rollers 392 are rotatably received in the roller housing ring 391. The packing ring 38 is stationarily positioned inside the housing unit 4 such that the outer ring hammer 33 is immobilized between the inner surface of the housing unit 4 and the packing ring 38, and is prevented from vibrating along the axial line (L1) while being rotated about the axial line (L1).

In the second embodiment, the packing ring 38 does not abut the outer ring hammer 33; rather it abuts the roller housing ring 391. Since a frictional force between the roller housing ring 391 and the packing ring 38 is greater than a frictional force between the outer ring hammer 33 and the roller bearing unit 39, through an abutment with the roller bearing unit 39 frictional forces generated by the outer ring hammer 33 can be reduced, and operational smoothness can be enhanced.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A twin hammer impact tool, comprising:

a motor including a motor shaft;

a drive unit driven by said motor, and including a gear set connected to said motor shaft;

a hammer unit connected to said drive unit, and including a hammer spindle extending along and rotatable about an axial line of said motor shaft, said hammer spindle having a driven end connected to said gear set, and an output end opposite to said driven end, an inner ring hammer sleeved on said hammer spindle, said inner ring hammer having a plurality of bead grooves, and a plurality of angularly spaced-apart hammer projections disposed around said output end of said hammer spindle, said inner ring hammer being reciprocally movable relative to said hammer spindle along the axial line while rotating together with said hammer spindle, an outer ring hammer disposed around said inner ring hammer, said outer ring hammer having a plurality of guiding grooves disposed around and extending along the axial line, said bead grooves respectively facing and opening toward said guiding grooves, a plurality of rolling beads each of which is singly received within one of said bead grooves and one of said guiding grooves, and an output hammer connected to said output end of said hammer spindle, and having a main body extending along the axial line for engaging a workpiece, and a plurality of angularly spaced engagement projections protruding radially from said main body for engaging said hammer projections; and a housing unit covering said motor, said drive unit and said hammer unit, and having an opening for said main body of said output hammer to extend outwardly, wherein each of said rolling beads has a ball shape, and each of said bead grooves has a shape of a ball half.

2. The twin hammer impact tool as claimed in claim 1, wherein said gear set has a sun gear connected to said motor shaft, a carrier, a plurality of planetary gears mounted to said carrier and meshed with said sun gear, and a ring gear meshed with said planetary gears, said carrier being connected to said hammer spindle, said ring gear being disposed around said planetary gears and positioned to said housing unit.

3. The twin hammer impact tool as claimed in claim 2, wherein:

said hammer spindle has an outer surface and two V-shaped grooves indented from said outer surface;

said inner ring hammer further has two sliding grooves, said sliding grooves respectively facing said V-shaped grooves;

said hammer unit further includes a spring and a plurality of rolling elements, said spring being sleeved on said hammer spindle and connecting between said carrier and said inner ring hammer, each of said rolling elements being disposed between one of said V-shaped grooves and one of said sliding grooves; and said rolling elements respectively slide in said V-shaped grooves such that said inner ring hammer is reciprocally moved along the axial line relative to said hammer spindle while being rotated together with said hammer spindle.

4. The twin hammer impact tool as claimed in claim 1, wherein said bead grooves are arranged annularly around the axial line.

5. The twin hammer impact tool as claimed in claim 4, wherein said bead grooves are equiangularly spaced apart from each other.

6. The twin hammer impact tool as claimed in claim 1, wherein:

said outer ring hammer further has a first end disposed around a portion of said main body of said output hammer proximate to said output end of said hammer spindle, and a second end opposite to said first end;

said hammer unit further includes a first packing ring that is disposed around said main body of said output hammer and that abuts the first end of said outer ring hammer, and a second packing ring that is disposed around said hammer spindle and that abuts said second end of said outer ring hammer.

7. The twin hammer impact tool as claimed in claim 1, wherein:

said outer ring hammer further has a head portion disposed around a portion of said main body of said output hammer proximate to said output end of said hammer spindle, and a neck portion extending from said head portion toward said gear set, said head portion abutting an inner surface of said housing unit;

said hammer unit further includes a packing ring that is disposed around said neck portion of said outer ring hammer, and a roller bearing unit having a roller housing ring, a plurality of cylindrical rollers, and a shoulder face, said roller housing ring being sleeved on said neck portion of said outer ring hammer, said shoulder face being formed at the juncture of said head and neck portions of said outer ring hammer, said roller housing ring being disposed between and in abutment with said packing ring and said shoulder face, said cylindrical rollers being received in said roller housing ring.

* * * * *